US010670363B2

(12) United States Patent
Roper et al.

(10) Patent No.: US 10,670,363 B2
(45) Date of Patent: Jun. 2, 2020

(54) NOISE ATTENUATION DEVICE

(71) Applicant: BAE SYSTEMS plc, London (GB)

(72) Inventors: Mark Edward Roper, USK Monmouthshire (GB); Craig Ian Young, USK Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 16/345,567

(22) PCT Filed: Oct. 5, 2017

(86) PCT No.: PCT/GB2017/053013
§ 371 (c)(1),
(2) Date: Apr. 26, 2019

(87) PCT Pub. No.: WO2018/078320
PCT Pub. Date: May 3, 2018

(65) Prior Publication Data

US 2019/0264997 A1 Aug. 29, 2019

(30) Foreign Application Priority Data

Oct. 28, 2016 (EP) ..... 16275159
Oct. 28, 2016 (GB) ..... 1618226.3

(51) Int. Cl.
*F41A 21/30* (2006.01)
*F41A 21/32* (2006.01)
(Continued)

(52) U.S. Cl.
CPC ..... *F41A 21/30* (2013.01); *F41A 21/325* (2013.01); *F41A 21/34* (2013.01); *F41A 21/36* (2013.01)

(58) Field of Classification Search
CPC ..... F41A 21/30; F41A 21/32; F41A 21/36; F41A 21/40; F41A 21/325; F41A 21/28; F41F 1/00
See application file for complete search history.

(56) References Cited

U.S. PATENT DOCUMENTS 3,528,336 A 9/1970 Donner
4,646,615 A * 3/1987 Gladstone ..... B29C 53/805 42/76.02
(Continued)

FOREIGN PATENT DOCUMENTS

EP 1837618 A1 9/2007
EP 1956335 A2 8/2008
(Continued)

OTHER PUBLICATIONS

International Preliminary Report on Patentability for PCT Application No. PCT/GB2017/053013 dated May 9, 2019, 15 pages.
(Continued)

*Primary Examiner* — Benjamin P Lee
(74) *Attorney, Agent, or Firm* — Finch & Maloney PLLC

(57) ABSTRACT

This invention relates to a noise attenuation device and in particular a device which provides an increased performance in the range of a mortar system.
A noise attenuation device suitable for use on a munition barrel, said device comprising an barrel extension portion, wherein the barrel extension portion has a length in the range of from 10 cm to 60 cm, at a first end of said barrel extension portion there is a tapered portion which tapers outwardly from said barrel extension portion, wherein said tapered portion, is frustoconical and has a cone angle in the range of from 22° to 28°, at a second end of the barrel extension portion a connector to secure the device onto a munition barrel.

20 Claims, 2 Drawing Sheets

(51) Int. Cl.
*F41A 21/34* (2006.01)
*F41A 21/36* (2006.01)

(56) References Cited

U.S. PATENT DOCUMENTS 5,429,032 A * 7/1995 Cytron ..... F41A 23/54 89/1.35
6,059,573 A * 5/2000 Patel ..... F41G 3/30 434/16
6,308,608 B1 10/2001 Eisenman
7,421,934 B1 * 9/2008 Madulka ..... F41A 33/00 102/445
7,735,408 B1 * 6/2010 Becker ..... F41F 1/06 102/374
7,963,202 B1 * 6/2011 Becker ..... F41F 1/06 42/76.01
9,863,732 B2 * 1/2018 Curliss ..... F41F 1/06
2006/0156804 A1 * 7/2006 Shipman ..... F41A 21/32 73/167
2006/0288854 A1 * 12/2006 Witherell ..... F41A 21/20 89/14.05
2007/0221051 A1 * 9/2007 Burkholder ..... F41A 21/34 89/1.35

FOREIGN PATENT DOCUMENTS

GB 247900 6/1926
GB 586749 A * 3/1947 ..... F41A 1/08
NL 6804528 A 10/1968
WO 9308439 4/1993
WO WO-2006078455 A1 * 7/2006 ..... F41A 21/32
WO 2013160330 A1 10/2013
WO 2018078320 A1 5/2018

OTHER PUBLICATIONS

International Search Report and Written Opinion received for PCT Application No. PCT/GB2017/053013. dated Jan. 19, 2018. 12 pages.
GB Search Report under Section 17(5) received for GB Application No. 1618226.3 dated Nov. 30, 2016. 4 pages.
Extended European Search Report received for EP Application No. 16275159.8, dated Dec. 6, 2016. 7 pages.

* cited by examiner

NOISE ATTENUATION DEVICE

FIELD OF THE INVENTION

This invention relates to a noise attenuation device and in particular a device which provides an increased performance in the range of a mortar system.

BACKGROUND

Blast attenuation devices such as muzzle brakes are well known in the art. They typically provide a means of allowing the rapid dispersion of the hot gases. Further features on these device is that they use apertures, such as slits or holes to allow the gases to disperse radially outwardly, to reduce the recoil of the barrel and attached ordnance.

SUMMARY OF THE INVENTION

In a first aspect, the present invention provides noise attenuation device suitable for use on a munition barrel, said device comprising an barrel extension portion, wherein the barrel extension portion has a length in the range of from 10 cm to 60 cm, at a first end of said barrel extension portion there is a tapered portion which tapers outwardly from said barrel extension portion, wherein said tapered portion, is frustoconical and has a cone angle in the range of from 22° to 28°, at a second end of the barrel extension portion a connector to secure the device onto a munition barrel.

The tapered portion may alternatively be, cupola, parabola, flared portion, to allow the controlled dispersion of the gases produced as the munition leaves the barrel.

Detailed optimised modelling has found that when the tapered portion is a frustoconical portion, has a cone angle $\alpha°$ in the range of from 22° to 28°, highly preferably a cone angle of substantially 25°.

Preferably the height of the tapered portion is in the range of from 5 cm to 30 cm, more preferably in the range of from 10 cm to 20 cm more preferably the height of the frustoconical portion is in the range of from 10 cm to 20 cm, most preferably 13.34 cm.

The tapered portion may have sides which may be substantially straight, parabolic, curved, trumpet shaped sides, in a highly preferred arrangement the tapered portion has substantially straight sides.

The frustoconical portion has a base. The plane of the base may be substantially perpendicular to the plane of the barrel extension portion or it may be an elliptical/parabolic conic section, or slant cut. The base may have any shaped cross section, such as for example elliptical, circular, square, highly preferably a right angled frustrated cone with a substantially circular base.

The tapered portion comprises an inner surface and an outer surface, the inner surface may comprise a textured surface, such as for example concave convex portions, such as for example ridges, grooves, voids, such as to alter the flow of the combustion gases.

The inner surface of the tapered portion may comprise a coating or layer, to alter the friction of the surface, such as paints, polymers etc.

The barrel extension portion is a tube with an internal diameter (bore) substantially the same as the internal diameter (bore) as the munition barrel to which it is attached, such that the munition to be launched retains substantially the same gas tight seal in the barrel extension portion. In a preferred arrangement the barrel extension portion has a length in the range of from 10 cm to 60 cm, more preferably 30 cm to 60 cm, yet more preferably 30 cm to 50 cm, more preferably 45 cm. Preferably the barrel extension portion has a length which is greater than the height of the frustoconical cone, more preferably the length is in the range of from 2 to 4 times the height of the frustoconical cone.

The device may be manufactured from any suitable material, such as a metal, polymer, composite, preferably a metal, preferably steel. Preferably the barrel extension portion and taper are selected from the same material.

The barrel extension portion, when deployed on the munition barrel, provides a temporary increase in overall barrel length, thereby increasing the time that the munition experiences the impulse from the hot expanding gases from the burning propellant. This may allow a reduction in the mass of propellant required to achieve the same range usually achievable with the munition's normal propellant mass. The reduction of propellant required to achieve the current maximum range, reduces the blast pressure. The combination of reduced propellant mass munition and a device according to the invention comprising a tapered portion may provide a reduction in noise to operators located around the weapon.

The use of a device comprising the barrel extension portion and frustoconical tapered portion on a 81 mm standard mortar barrel in combination with an 81 mm mortar with 20% reduced propellant mass, has been demonstrated to provide a 5 dB reduction in noise to operators located proximate to the device, whilst maintaining the required distance for the mortar bomb.

Ii has been shown that a device when attached to a munition barrel allows a reduced mass propellant munition to be launched and to achieve substantially the same range.

The connector must provide a gas tight seal between the device and the munition barrel. The connector and munition barrel may comprise co-operatively engaging surfaces, such as threads, collets, locking rings.

The tapered portion may be reversibly attached to the barrel extension portion, such that the device may be more conveniently stored.

According to a further aspect of the invention there is provided a munition system comprising a munition barrel, a munition capable of being launched via said barrel, and a noise attenuation device as defined herein, said attenuation device attached by a connector to said munition barrel, wherein the munition has a reduced mass of propellant. The reduction may be at least 1% wt, preferably at least 10% wt, more preferably in the range of from 5 to 20% wt.

DETAILED DESCRIPTION

Figure 1:
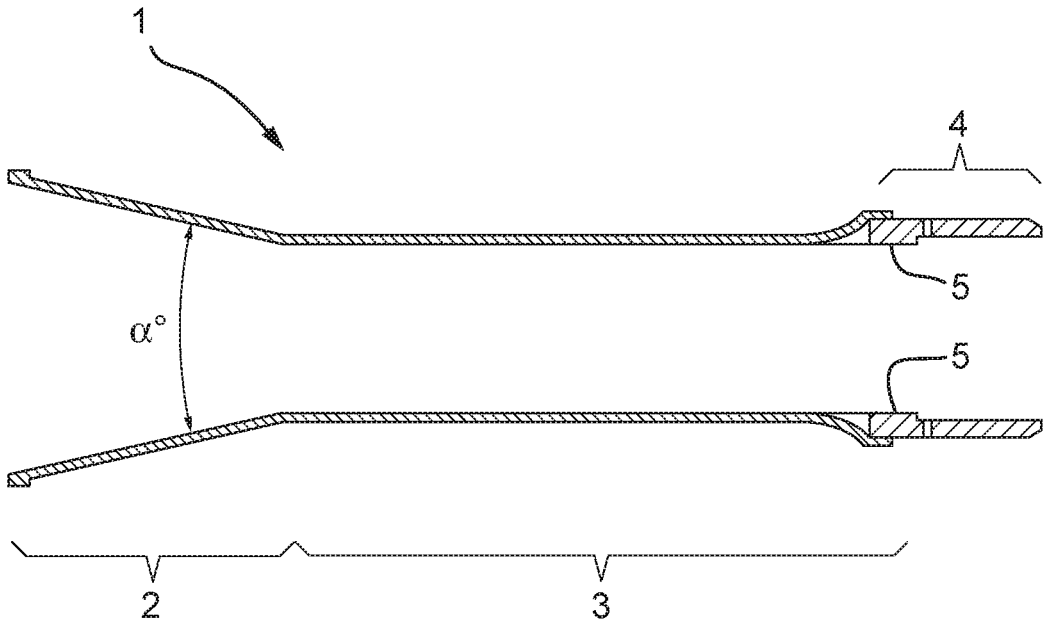
FIG. 1 *a, b* cross section of a noise reduction device, with a connector.

Turing to FIG. 1 there is provided a noise attenuation device 1, the device comprises a barrel extension portion 3. At a first end of the barrel extension portion 3 is a tapered portion 2, which is preferably in the form of a frustrated cone. The tapered portion 2, is tapered such that the sides expand outwardly as a function of distance from the barrel extension portion. The cone angle $\alpha°$ is 25°. At the second end of the barrel extension portion 3 is a connector 4. The connector 4 allows the barrel extension portion 3 to be connected to an existing munition barrel, such as a mortar barrel. The inner surface (bore) 5 of the barrel extension portion 3, should be substantially the same bore as the munition barrel to ensuring a gas tight seal with a munition progressing up the barrel extension portion.

Figure 2A:
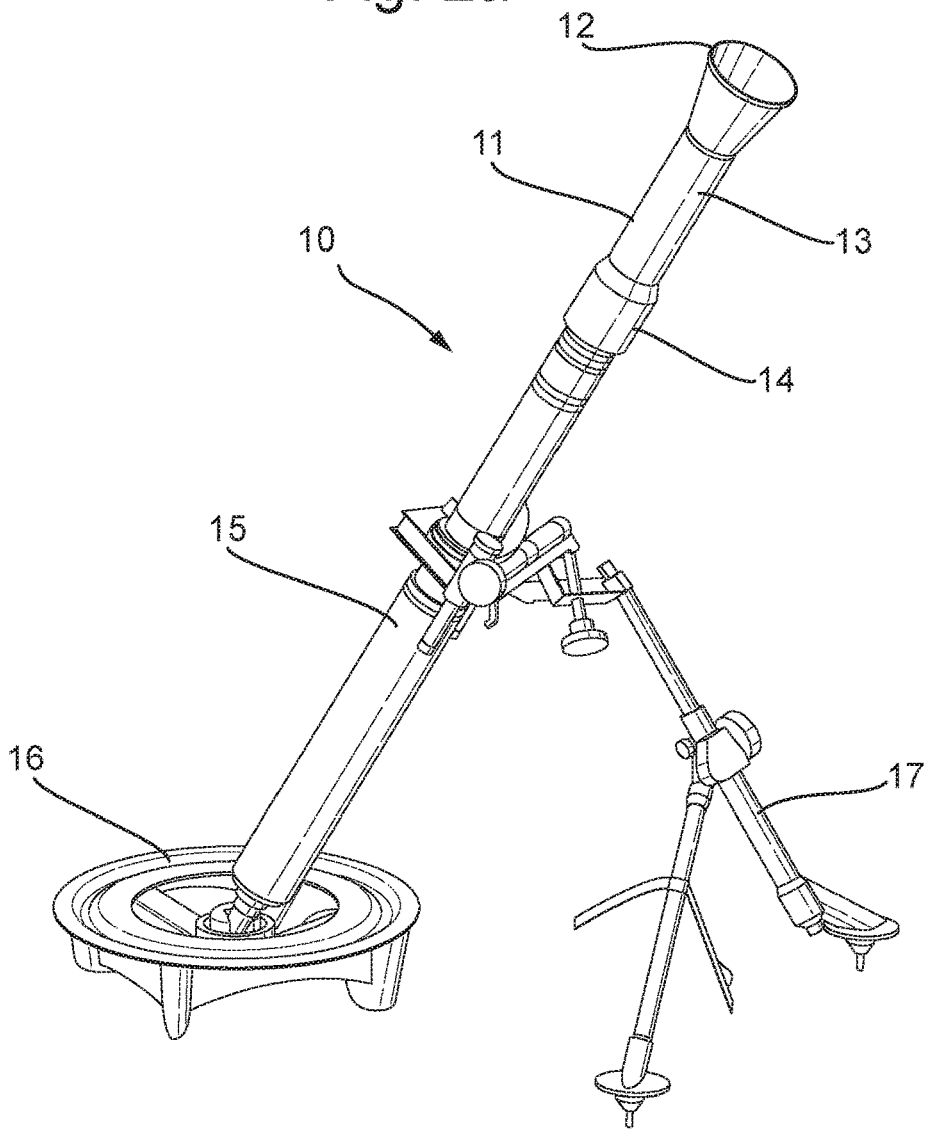
FIG. 2*a*, 2*b*, show a side view of a mortar barrel with a noise reduction device attached thereto, and a mortar.
Figure 2B:
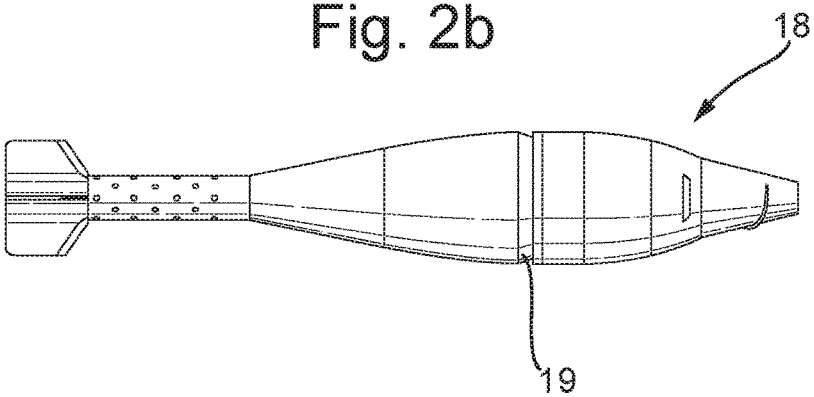

Turing to FIG. 2*a*, there is provided a L16 81 mm mortar 10, which has been in service since 1965. The mortar launcher 10 comprises a barrel portion 15, which is supported by a base plate 16, which may be sunk into the ground. The mortar launcher 10, is further supported by a bi-pod 17, to allow the mortar launcher 10 to be arranged at a specific elevation. At the open end of the mortar barrel 15, is located a noise reduction device 11. The noise reduction device 11 comprises a barrel extension portion 13. At a first end of the barrel extension portion 13 is a tapered portion 12, which is preferably in the form of a frustrated cone. The connector 14 reversibly connects the noise reduction device 11 to the open end of the barrel 15.

A mortar bomb 18 is then deposited down the elongate barrel portion 12 and barrel 15. It is essential that the elongate barrel portion 12 and barrel 15 are of substantially the same bore, (same inner diameters) such that the mortar bomb 18 forms a gas tight seal via the obturator 19, with the inner wall of the barrel 15 and elongate barrel portion 12.

The invention claimed is:

1. A noise attenuation device suitable for use on a mortar barrel, said device comprising a barrel extension portion, wherein the barrel extension portion has a length in the range of from 10 cm to 60 cm and a cylindrical bore diameter consistent with that of the mortar barrel, and wherein at a first end of said barrel extension portion there is a tapered portion which tapers outwardly from said barrel extension portion, and wherein said tapered portion is frustoconical and has a cone angle in the range of from 22° to 28°, and wherein at a second end of the barrel extension portion there is a connector to secure the device onto a mortar barrel;

wherein the device, when attached to the munition barrel, allows a munition with relatively lesser propellant mass to be launched from the munition barrel and achieve substantially the same range as when a munition with relatively greater propellant mass is launched from the munition barrel without the device attached.

2. The device according to claim 1, wherein the tapered portion has a cone angle of substantially 25°.

3. The device according to claim 2, wherein a height of the tapered portion is in the range of from 10 cm to 17 cm.

4. The device according to claim 1 wherein the barrel extension portion has a length in the range of from 30 cm to 60 cm.

5. The device according to claim 1 wherein the barrel extension portion has a length in the range of from 30 cm to 50 cm.

6. The device according to claim 1 wherein the munition with relatively lesser propellant mass has a reduced charge and the munition with relatively greater propellant mass has a standard charge.

7. The device according to claim 1 wherein the connector and mortar barrel comprise co-operatively engaging surfaces.

8. The device according to claim 1 wherein the tapered portion is removably attached to the barrel extension portion.

9. The device according to claim 1 wherein the barrel extension portion has a length of about 45 cm.

10. The device of claim 1, wherein an axial length of the barrel extension portion is greater than an axial length of the tapered portion.

11. A mortar system comprising:

a mortar barrel for launching a mortar;

a noise attenuation device configured for attachment to the mortar barrel, said device comprising a barrel extension portion, wherein the barrel extension portion has a length in the range of from 10 cm to 60 cm and a cylindrical bore diameter consistent with that of the mortar barrel, and wherein at a first end of said barrel extension portion there is a tapered portion which tapers outwardly from said barrel extension portion, and wherein said tapered portion is frustoconical and has a cone angle in the range of from 22° to 28°, and wherein at a second end of the barrel extension portion there is a connector to secure the device onto the mortar barrel, said noise attenuation device attached by the connector to said mortar barrel, wherein the barrel extension portion increases a length of the mortar barrel to allow a mortar having a reduced mass of propellant to achieve substantially the same range when launched from the mortar system as a mortar with relatively greater propellant mass is launched from the mortar barrel without the noise attenuation device attached to the mortar barrel.

12. The system according to claim 11, further comprising the mortar having the reduced mass of propellant, wherein the mortar having the reduced mass of propellant has a reduction of propellant is in the range of from 5 to 20% wt. compared to the mortar with relatively greater propellant mass.

13. A noise attenuation device suitable for use on a munition barrel, said device comprising a cylindrical barrel extension portion, wherein the barrel extension portion has a length in the range of from 10 cm to 60 cm and a bore diameter consistent with that of the munition barrel, and wherein at a first end of said barrel extension portion there is a tapered portion which tapers outwardly from said barrel extension portion, and wherein said tapered portion is frustoconical and has a cone angle in the range of from 22° to 28°, and wherein at a second end of the barrel extension portion there is a connector to secure the device onto the munition barrel, and wherein the device when attached to the munition barrel allows a reduced mass propellant munition to be launched from the munition barrel and to achieve substantially the same range as when a munition with relatively greater propellant mass is launched without the device attached to the munition barrel, and wherein the connector and munition barrel comprise co-operatively engaging surfaces.

14. The device according to claim 13, wherein the tapered portion has a cone angle of substantially 25°.

15. The device according to claim 14, wherein a height of the tapered portion is in the range of from 10 cm to 17 cm.

16. The device according to claim 13, wherein the barrel extension portion has a length in the range of from 30 cm to 60 cm.

17. The device according to claim 13, wherein the barrel extension portion has a length in the range of from 30 cm to 50 cm.

18. The device according to claim 13, wherein the tapered portion is removably attached to the barrel extension portion.

19. A munition system comprising a munition barrel, a munition capable of being launched via said barrel, and a noise attenuation device, said noise attenuation device attached by a connector to said munition barrel, wherein the munition has a reduced mass of propellant, said noise attenuation device including a barrel extension portion, wherein the barrel extension portion has a length in the range of from 30 cm to 60 cm and a cylindrical bore consistent with that of the munition barrel, and wherein at a first end of said barrel extension portion there is a tapered portion which tapers outwardly from said barrel extension portion, and wherein said tapered portion is frustoconical and has a cone angle in the range of from 22° to 28°, and wherein at a second end of the barrel extension portion is the connector;

wherein the barrel extension portion increases a length of the munition barrel to allow the munition having the reduced mass of propellant munition to achieve substantially the same range when launched from the munition system as when a munition with relatively greater propellant mass is launched from the munition barrel without the noise attenuation device attached to the munition barrel.

20. The system according to claim 19, wherein the reduction of propellant in the munition of reduced mass of propellant compared to the munition with relatively greater propellant mass is in the range of from 5 to 20% wt.

* * * * *